US007798337B2

(12) United States Patent
Gard et al.

(10) Patent No.: US 7,798,337 B2
(45) Date of Patent: Sep. 21, 2010

(54) METHOD OF MOUNTING CASKET PORTION TO DISPLAY

(75) Inventors: Brian Carl Gard, Greensburg, IN (US); Joseph Leo Giesey, III, Batesville, IN (US); Colleen Josephine Klimara, Cincinnati, OH (US); Daniel J. Parker, Connersville, IN (US); Todd Jeffrey Tekulve, Batesville, IN (US); Mark Steven Williams, Batesville, IN (US)

(73) Assignee: Batesville Services, Inc., Batesville, IN (US)

( * ) Notice: Subject to any disclaimer, the term of this patent is extended or adjusted under 35 U.S.C. 154(b) by 372 days.

(21) Appl. No.: 11/777,381

(22) Filed: Jul. 13, 2007

(65) Prior Publication Data

US 2009/0014396 A1 Jan. 15, 2009

(51) Int. Cl.
*A47G 19/00* (2006.01)

(52) U.S. Cl. ..... 211/85.16; 27/10

(58) Field of Classification Search ..... 211/85.16, 211/85.27, 119.002, 13.1, 189, 186, 134; 108/90, 93, 101; 312/351; 27/27
See application file for complete search history.

(56) References Cited

U.S. PATENT DOCUMENTS 2,595,002 A * 4/1952 Schneider ..... 108/101
3,788,700 A * 1/1974 Wartes ..... 297/440.13
4,318,576 A * 3/1982 Ford ..... 312/264
5,139,155 A * 8/1992 Laxson ..... 211/169
5,405,017 A 4/1995 Szabo, Sr. et al.
5,478,145 A * 12/1995 Kamachi ..... 312/263
5,524,394 A 6/1996 Szabo, Sr. et al.
5,709,052 A 1/1998 Szabo, Sr. et al.
5,797,499 A 8/1998 Pinco
D398,026 S 9/1998 Riga
D398,027 S 9/1998 Riga
D398,654 S 9/1998 Riga
D399,880 S 10/1998 Riga
5,848,498 A 12/1998 Szabo, Sr. et al.
D404,884 S 1/1999 Salatin et al.
D407,180 S 3/1999 Riga
5,901,862 A 5/1999 Riga et al.
5,901,863 A 5/1999 Riga et al.
5,960,966 A 10/1999 Riga et al.
D420,838 S 2/2000 Riga
D426,404 S 6/2000 Riga et al.
6,070,741 A 6/2000 Bachman et al.
D428,289 S 7/2000 Bachman et al.
6,101,954 A * 8/2000 Rein et al. ..... 108/50.02

(Continued)

*Primary Examiner*—Jennifer E. Novosad
(74) *Attorney, Agent, or Firm*—Wood, Herron & Evans, LLP

(57) ABSTRACT

A display for displaying casket portions comprises a back wall, at least one wing wall, a shelf, a casket corner section having two cut sides at substantially a right angle to one another and having a bottom, a side panel attached to one of the cut sides of the casket corner section, a bottom panel attached to the bottom of the casket corner section, and at least one dowel pin on the back wall. The casket corner section is supported on the shelf, the side panel is positioned between the wing wall and the dowel pin, and the other cut side faces the back wall. The dowel pin is spaced from the wing wall by an amount such that an outwardly facing surface of the side panel is snugged against an inwardly facing surface of the wing wall.

19 Claims, 5 Drawing Sheets

U.S. PATENT DOCUMENTS

Figure 1A:
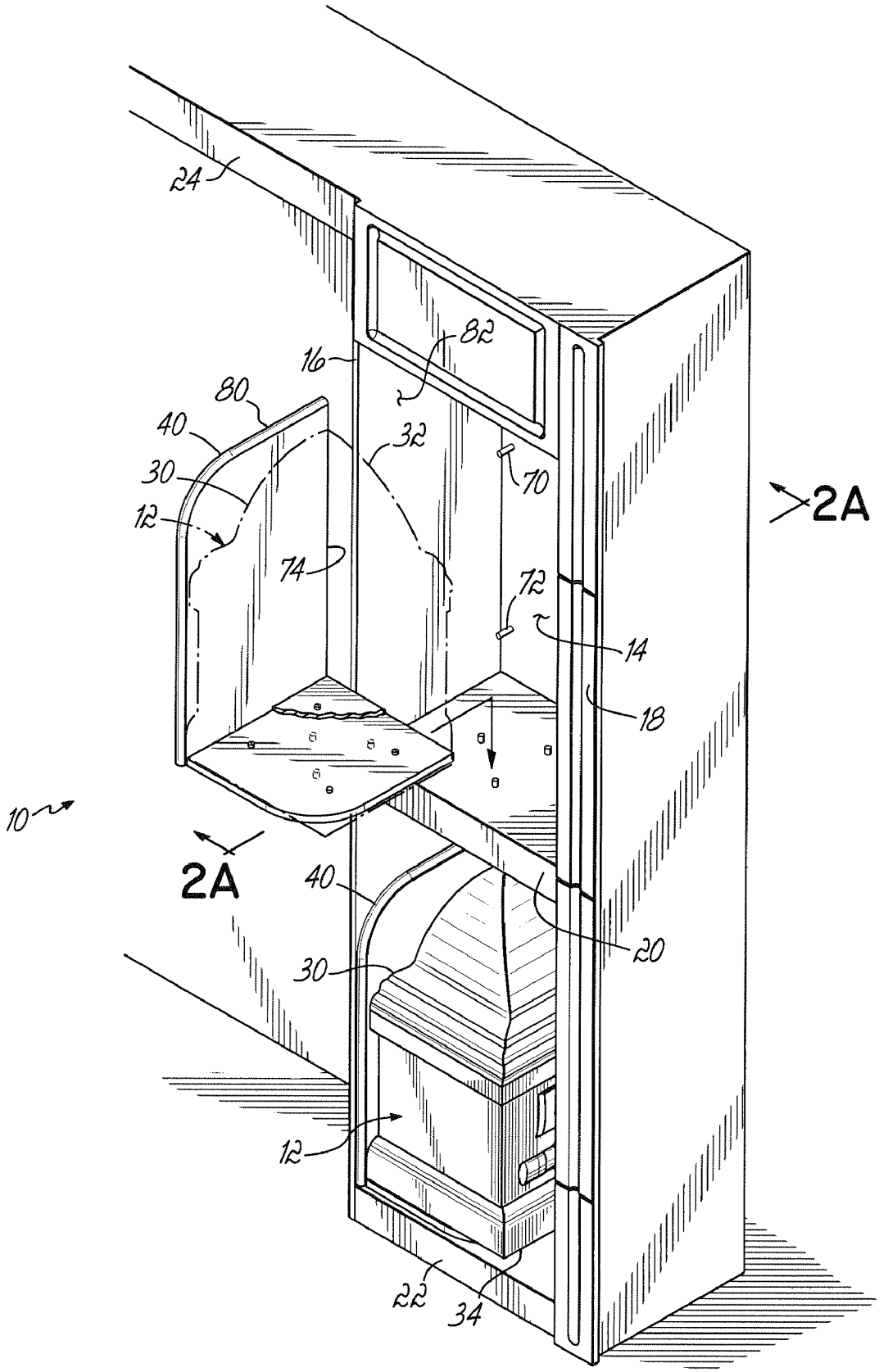

| | | | | |
|---|---|---|---|---|
| 6,105,793 | A | 8/2000 | Riga | |
| 6,142,313 | A * | 11/2000 | Young | 211/4 |
| 6,145,671 | A | 11/2000 | Riga et al. | |
| 6,145,672 | A | 11/2000 | Bachman et al. | |
| 6,161,705 | A | 12/2000 | Riga et al. | |
| D438,030 | S | 2/2001 | Riga | |
| D439,445 | S | 3/2001 | Riga et al. | |
| D440,796 | S | 4/2001 | Riga | |
| 6,257,423 | B1 | 7/2001 | Riga et al. | |
| 6,276,034 | B1 | 8/2001 | Bachman et al. | |
| D451,309 | S | 12/2001 | Riga et al. | |
| 6,343,701 | B2 | 2/2002 | Riga et al. | |
| D464,498 | S | 10/2002 | Riga et al. | |
| 6,467,634 | B1 | 10/2002 | Pinco | |
| 6,467,637 | B2 | 10/2002 | Riga | |
| D468,560 | S | 1/2003 | Riga | |
| 6,585,118 | B2 | 7/2003 | Kellogg | |
| 6,681,510 | B1 | 1/2004 | Salatin et al. | |
| 7,036,196 | B2 | 5/2006 | Salatin et al. | |
| D525,807 | S | 8/2006 | Pinco | |
| 7,107,222 | B1 | 9/2006 | Riga | |
| 7,191,906 | B1 | 3/2007 | Pinco | |
| 2001/0002660 | A1 | 6/2001 | Riga et al. | |
| 2002/0033372 | A1 | 3/2002 | Kellogg | |
| 2003/0000901 | A1 | 1/2003 | Salatin et al. | |
| 2005/0252425 | A1 * | 11/2005 | Dardashti | 108/61 |
| 2007/0193961 | A1 * | 8/2007 | Kershner | 211/13.1 |
| 2007/0227054 | A1 | 10/2007 | Bowers et al. | |
| 2008/0277363 | A1 * | 11/2008 | McDonough | 211/189 |

* cited by examiner

METHOD OF MOUNTING CASKET PORTION TO DISPLAY

FIELD

This invention relates generally to the funeral service industry, and more particularly to a display system facilitating the selection by a customer of funerary products in, for example, a funeral home selection room.

BACKGROUND

Funeral home casket selection rooms have evolved as those in the industry have attempted to better meet the funeral customers' needs. The "traditional" presentation of product in a funeral home selection room was to simply place each casket on a bier and open the head end cap or lid of the casket to permit viewing inside the casket. As many caskets as possible were displayed in a selection room in order to maximize the number of product choices for the customer. Unfortunately, such a "traditional" presentation results in what has been referred to as a "sea of caskets" visual effect, which can be both distressing or alarming and confusing to the customer.

Advances in the design of funeral home selection rooms have taken the form of providing a plurality of alcove structures, either of a "modular" construction or of a "stick built" construction, in the funeral home selection room. Each alcove structure includes a vertical back wall and a pair of vertical, spaced apart wing walls cooperating with the back wall to form an alcove. A soffit may span the upper front edges of the wing walls, and lighting, for example track lighting, may be incorporated into the soffit. A two-tier casket rack is located within the alcove, the lower tier of the casket rack being a roll out rack permitting the lower casket to be rolled out from under the upper casket and the casket lid opened for display of the lower casket. Tasteful signage and the like is mounted on the back wall above the caskets. Such a construction, which is the subject of the assignee's prior U.S. Pat. Nos. 5,405,017 and 5,524,394, both hereby incorporated by reference herein, increases the number of caskets which can be displayed in a funeral home selection room, as well as greatly improves the "look and feel" of the casket presentations, thereby reducing the clutter and confusion of the so-called "sea of caskets" effect and providing a feeling of comfort to the families.

New construction and renovation costs being what they are, there is an ever-increasing need to increase the product density displayable in the funeral home selection room, without sacrificing comfort, convenience and look and feel of the casket display systems of U.S. Pat. Nos. 5,405,017 and 5,524,394. To that end, the assignee's U.S. Pat. No. 6,681,510, hereby incorporated by reference herein, discloses and claims a Display For A Casket Selection And/Or Viewing Room. That patent discloses the display of a plurality of casket portions along with a plurality of casket information modules. Each information module corresponds to one of the casket portions displayed and houses an insert displaying samples of the various features of the particular casket, for example, a portion of the cap panel, a photo of the casket, a fabric swatch of the casket fabric, etc. To access and view the casket samples displayed on the insert, a door to the module is opened, and the insert is slid out of the module.

By way of further advances, the assignee's U.S. Patent Application Publication No. 2005/0000926 A1, hereby incorporated by reference herein, discloses and claims a Display For A Casket Selection Room. That application discloses a display for a casket selection room comprising a wall, a plurality of casket portions displayed on the wall, and a plurality of casket information modules displayed on the wall. Each information module corresponds to one of the casket portions and includes a photo of the casket, a portion of a cap panel of the casket and/or a fabric swatch of the casket. The photo, portion of the cap panel and/or fabric swatch are visible to the customer without opening the information module. The casket selection display of U.S. Patent Application Publication No. 2005/0000926 A1 thereby provides further advantages above and beyond the casket selection display disclosed in U.S. Pat. No. 6,681,510, for example obviating the need to open a door of the casket information module and remove the casket information insert in order to be able to view the same.

A problem associated with displaying casket corner portions arises when attempting to mount the casket corner portion to a display. Since the casket corner portions being displayed are literally cut from full size caskets, it is desirable to conceal the cut edges from view when mounted. However, cutting the casket corner portions from full size caskets results in a high degree of flexibility of the cut casket corner portions. Therefore, simply abutting the cut edges of the casket portion against walls of the display does not always insure that the cut edges will remain biased against the display walls so as to conceal the cut edges of the casket portion, due to the flexibility of the cut corner portion. This is especially problematic when working with sheet metal caskets and corner portions thereof for display.

Accordingly, It is desirable to provide further improvements in the area of partial casket display and selection.

SUMMARY

A display for displaying casket portions comprises a back wall, at least one wing wall, a shelf, a casket corner section having two cut sides at substantially a right angle to one another and having a bottom, a side panel attached to one of the cut sides of the casket corner section, a bottom panel attached to the bottom of the casket corner section, and at least one dowel pin on the back wall. The casket corner section is supported on the shelf, the side panel is positioned between the wing wall and the dowel pin, and the other cut side faces the back wall. The dowel pin is spaced from the wing wall by an amount such that an outwardly facing surface of the side panel is snugged against an inwardly facing surface of the wing wall.

The bottom of the casket corner section can be attached to the bottom panel with screws. The casket corner section can have blocks attached to an interior thereof and the side panel can be attached to the blocks with screws. The blocks can be glued to the interior of the casket corner section. The side panel and bottom panel can be attached to one another with screws. The shelf can include at least one dowel pin thereon, and the bottom panel can include a locating hole therein which accepts the dowel pin on the shelf. The back wall, wing wall, and shelf can be attached to one another. The casket corner section can be fabricated from wood or sheet metal. The display can include a pair of wing walls, the shelf spanning between the pair of wing walls. The back wall can include a pair of vertically spaced dowel pins thereon. The shelf can include a pair of spaced dowel pins thereon and the bottom panel can include a pair of locating holes therein which accept the dowel pins on the shelf.

In another aspect, a display for displaying casket portions comprises a back wall, at least one wing wall, a shelf, a casket corner section having two cut sides at substantially a right angle to one another and having a bottom, a side panel attached to one of the cut sides of the casket corner section, a bottom panel attached to the bottom of the casket corner section, and at least one locator on the back wall. The casket corner section is supported on the shelf, the side panel is positioned between the wing wall and the locator, and the other of the cut sides faces the back wall. The locator is spaced from the wing wall by an amount such that an outwardly facing surface of the side panel is snugged against an inwardly facing surface of the wing wall.

The back wall can have a pair of vertically spaced locators thereon. The locators can be pins, for example dowel pins.

In yet another aspect, a display for displaying casket portions comprises a back wall, a pair of wing walls, a pair of vertically spaced shelves, two casket corner sections, each casket corner section having two cut sides at substantially a right angle to one another and having a bottom, a side panel attached to one of the cut sides of each casket corner section, a bottom panel attached to the bottom of each casket corner section, and two pairs of vertically spaced pins on the back wall, one pair of pins being located above an upper one of the pair of shelves and the other pair of pins being located above a lower one of the pair of shelves and below the upper shelf. One casket corner section is supported on each shelf. Each side panel is positioned between one of the wing walls and a respective pair of pins, and each of the other of the cut sides faces the back wall. The pins are spaced from the wing wall by an amount such that an outwardly facing surface of each side panel is snugged against an inwardly facing surface of the wing wall.

These and other features and advantages of the present invention will become more readily apparent during the following detailed description taken in conjunction with the drawings herein, in which:

DRAWINGS

Figure 1B:
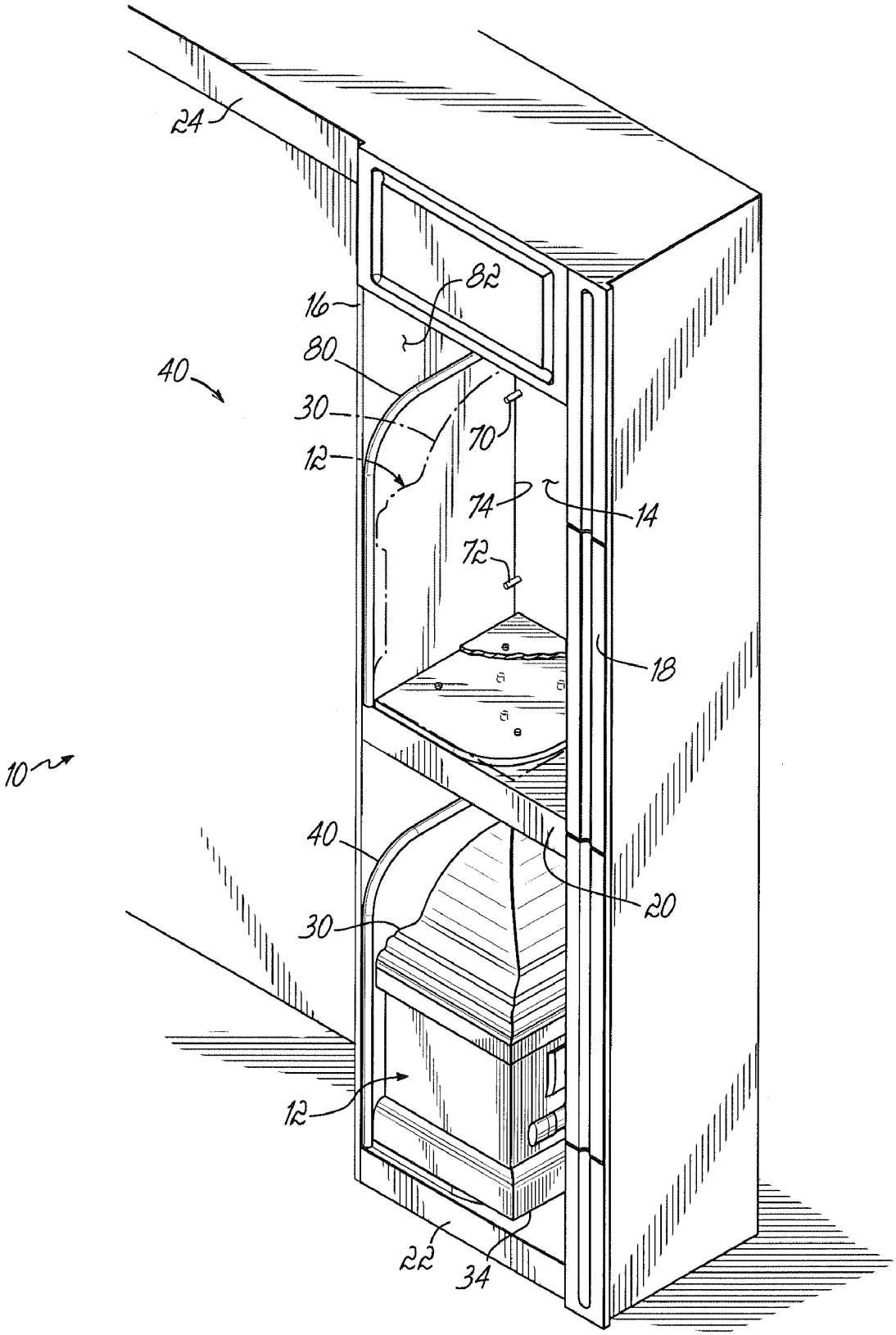
Figure 2A:
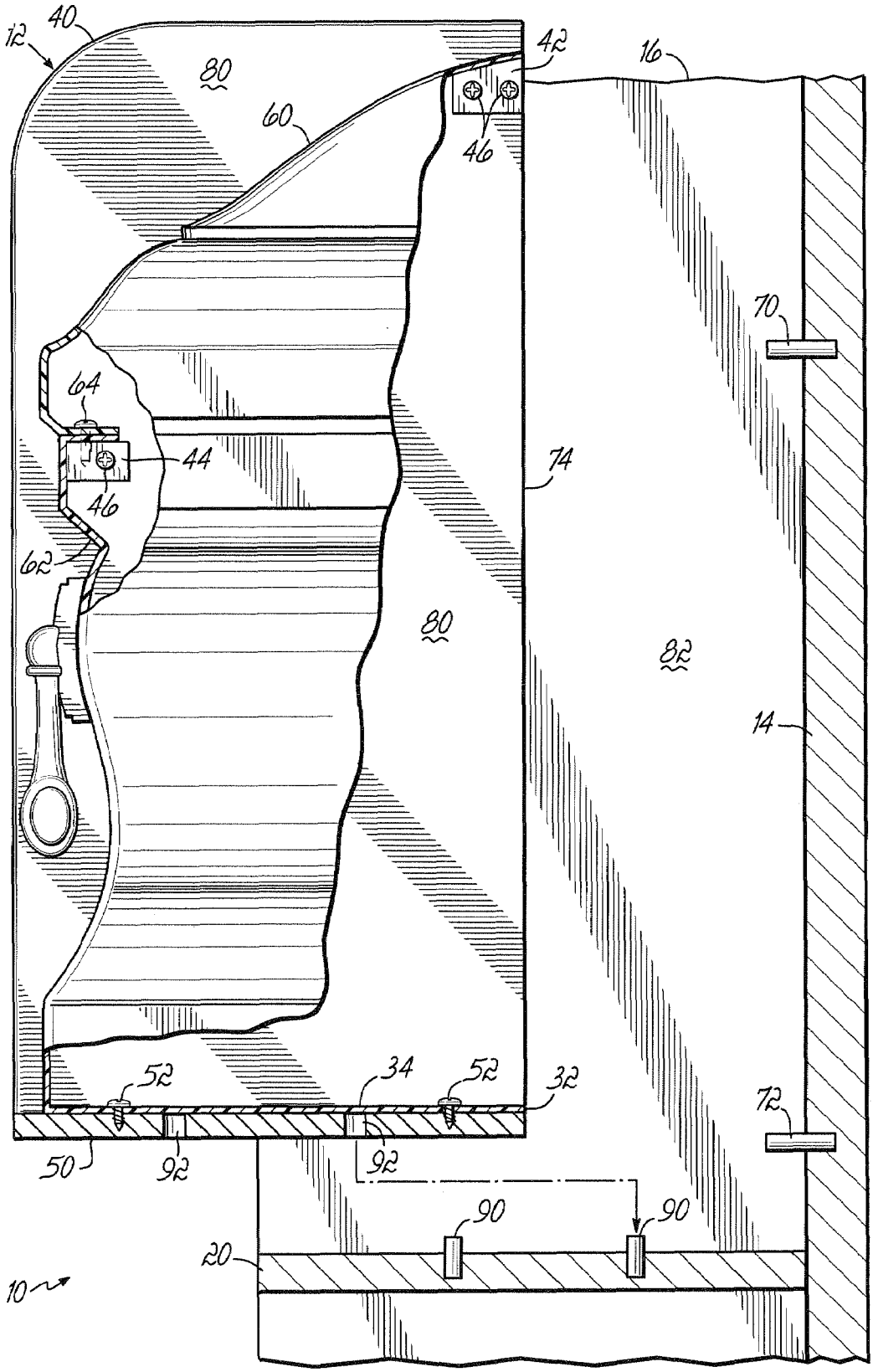
Figure 2B:
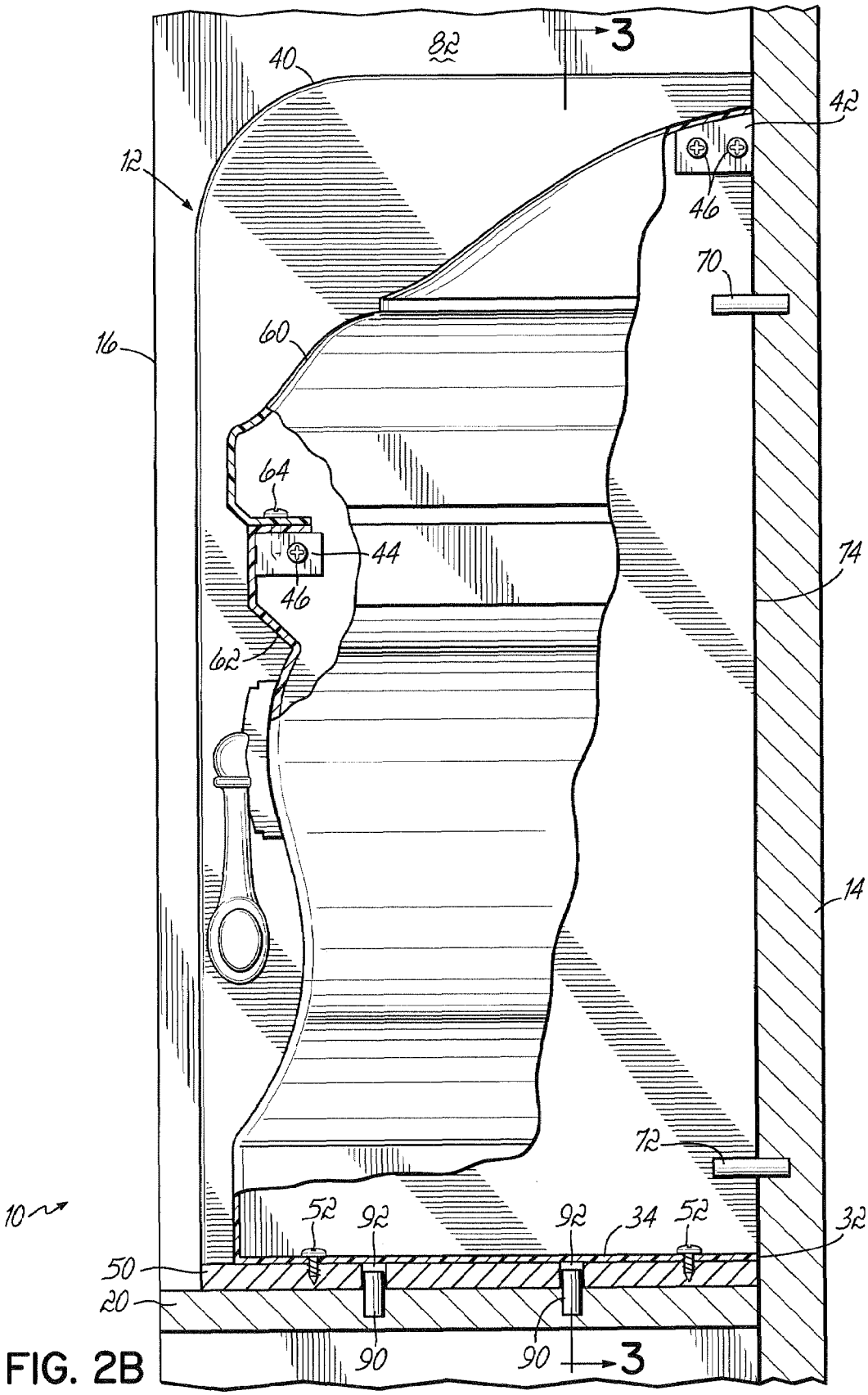
Figure 3:
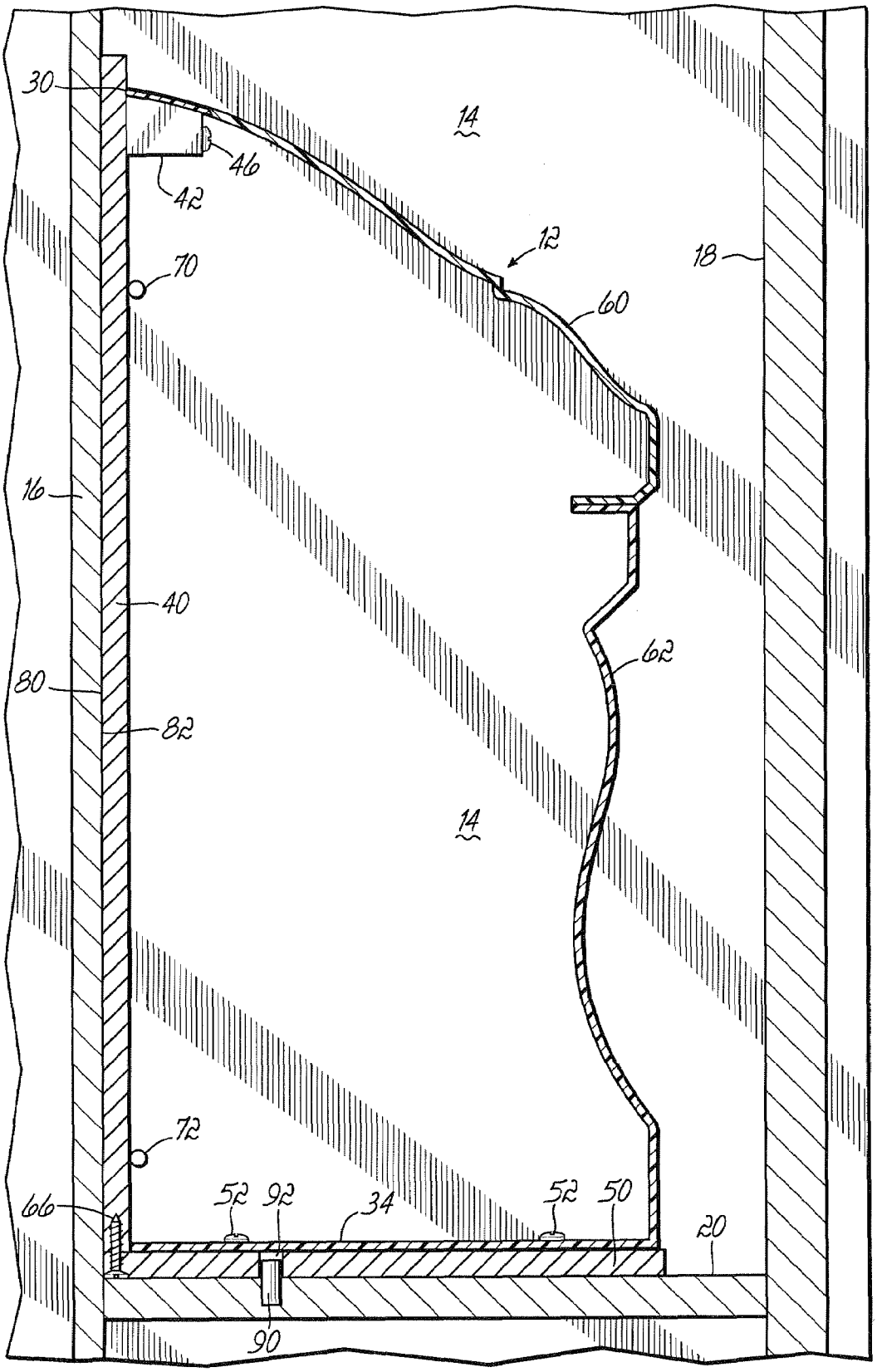

FIG. 1A is a perspective view, partially exploded, and partially broken away, of the display for displaying casket portions, FIG. 1B is a view similar to FIG. 1A but of the assembled display, FIG. 2A is a view taken along line 2A-2A in FIG. 1A, FIG. 2B is a view similar to FIG. 2A but of the assembled display, and FIG. 3 is a view taken along line 3-3 in FIG. 2B.

DESCRIPTION

Referring first to FIGS. 1A and 1B, a display 10 for displaying casket portions 12 has a back wall 14, at least one wing wall 16, and preferably a pair of wing walls 16, 18, and at least one shelf 20, and preferably a pair of shelves 20, 22. Display 10 can used in stand-alone fashion, or incorporated into a larger display 24 of funerary products.

Referring to all the Figs., each casket portion 12 is a corner section of a casket to be displayed having two cut sides 30, 32 at substantially a right angle to one another, and a bottom 34. A side panel 40, fabricated of, for example, wood, is attached to cut side 30. For example, the casket corner section 12 can have blocks 42, 44, for example wooden blocks 42, 44, attached to an interior thereof by, for example, glue. Fasteners 46, for example screws, can be used to attach side panel 40 to the blocks 42, 44. A bottom panel 50, fabricated of, for example, wood, is attached to the bottom 34 of casket corner section 12 with fasteners 52, for example screws. The lid portion 60 of the casket corner section 12 can be secured to the shell portion 62 of the casket corner section 12 with one or more fasteners, for example screws 64. For rigidity, the side panel 40 and bottom panel 50 can be attached to one another with screws 66 (FIG. 3). The side panel 40 and bottom panel 50, as well as back wall 14, wing walls 16, 18, and shelves 20, 22, can be painted, clad in decorative vinyl, etc. for appearance as desired.

At least one 70, and preferably a vertically spaced pair 70, 72, of locators, for example, pins, for example dowel pins, are in and/or on the back wall 14. When the casket corner section 12 is placed onto shelf 20 and supported thereon, the rear edge 74 of side panel 40 is positioned between the wing wall 16 and the pins 70, 72. The other cut side 32 of the casket corner section 12 faces the back wall 14. The pins 70, 72 are spaced from the wing wall 16 by an amount such that an outwardly facing surface 80 of the side panel 40 is snugged against an inwardly facing surface 82 of the wing wall 16. In this way, the normally flexible casket corner section 12 is rigidified, and no unsightly gaps appear between the casket corner section 12 and the wing wall 16. The distance of the pins 70, 72 from the wing wall 16 is determined by the thickness of the side panel 40; the distance should be such as to allow the side panel 40 to easily slip between the wing wall 16 and the pins 70, 72, but not so great as to allow the side panel to lean or otherwise flex away from the side wall 16 so as to create an unsightly gap therebetween. In any event, the weight of the casket corner section 12 is carried by the shelf 20 and not by the wing wall 16. Stated differently, in the absence of the shelf 20, the combination of pins 70, 72 and wing wall 16 could not bear the weight of the casket corner section 12; the casket corner section 12 would simply drop downwardly and fall from the display 10. Thus, the casket corner section 12 is not, and cannot be said to be, secured by its side surface onto the wing wall 16 (or back wall 14, for that matter).

As best shown in FIGS. 2A, 2B, and 3, shelves 20, 22 can include one or more dowel pins 90 therein/thereon which are accepted by locating holes 92 in bottom panel 50 to further secure casket corner section 12 to shelf 20 (or 22).

Any or all of the back wall 14, wing walls 16, 18, and shelves 20, 22 can be attached to one another to rigidify the display 10.

The casket corner sections 12 can be fabricated of wood or sheet metal.

The embodiments shown and described are merely for illustrative purposes only. The drawings and the description are not intended to limit in any way the scope of the claims. Those skilled in the art will appreciate various changes, modifications, and alternative embodiments. For example, structure other than dowel pins, or pins, can be used to locate the side panel against the wing wall, such as angle brackets, studs, screws, bolts, nails, etc. All such changes, modifications and embodiments are deemed to be embraced by the claims. Accordingly, the scope of the right to exclude shall be limited only by the following claims and their equivalents.

What is claimed is:

1. A casket portion adapted to be supported and displayed on a display, the display having a back wall, at least one wing wall, a shelf, and at least one dowel pin on the back wall, said casket portion comprising:

a casket corner section having two cut sides at substantially a right angle to one another and having a bottom, a side panel attached to one of said cut sides of said casket corner section, and a bottom panel attached to said bottom of said casket corner section, said casket corner section adapted to be supported on the shelf, said side panel adapted to be positioned between the wing wall and the dowel pin, and the other of said cut sides adapted to face the back wall, said side panel having a thickness so as to adapt an outwardly facing surface of said side panel to be snugged against an inwardly facing surface of the wing wall by the dowel pin.

2. The casket portion of claim 1 wherein said bottom of said casket corner section is attached to said bottom panel with screws.

3. The casket portion of claim 1 wherein said casket corner section has blocks attached to an interior thereof and said side panel is attached to said blocks with screws.

4. The casket portion of claim 3 wherein said blocks are glued to said interior of said casket corner section.

5. The casket portion of claim 1 wherein said side panel and bottom panel are attached to one another with screws.

6. The casket portion of claim 1 wherein the shelf includes at least one dowel pin thereon, and said bottom panel includes a locating hole therein which is adapted to accept the dowel pin on the shelf.

7. The casket portion of claim 1 wherein the back wall, wing wall, and shelf are attached to one another.

8. The casket portion of claim 1 wherein said casket corner section is fabricated from wood.

9. The casket portion of claim 1 wherein said casket corner section is fabricated from sheet metal.

10. The casket portion of claim 1 wherein the display includes a pair of wing walls and the shelf spans between the pair of wing walls.

11. The casket portion of claim 1 wherein the back wall has a pair of vertically spaced dowel pins thereon.

12. The casket portion of claim 1 wherein the shelf includes a pair of spaced dowel pins thereon and said bottom panel includes a pair of locating holes therein which accept the dowel pins on the shelf.

13. A casket portion adapted to be supported and displayed on a display, the display having a back wall, at least one wing wall, a shelf, and at least one locator on the back wall, said casket portion comprising:

a casket corner section having two cut sides at substantially a right angle to one another and having a bottom, a side panel attached to one of said cut sides of said casket corner section, and a bottom panel attached to said bottom of said casket corner section, said casket corner section adapted to be supported on the shelf, said side panel adapted to be positioned between the wing wall and the locator, and the other of said cut sides adapted to face the back wall, said side panel having a thickness so as to adapt an outwardly facing surface of said side panel to be snugged against an inwardly facing surface of the wing wall by the locator.

14. The casket portion of claim 13 wherein the back wall has a pair of vertically spaced locators thereon.

15. The casket portion of claim 14 wherein the locators are pins.

16. The casket portion of claim 15 wherein the pins are dowel pins.

17. The casket portion of claim 13 wherein the shelf includes a pair of spaced locators thereon and said bottom panel includes a pair of locating holes therein which accept the locators on the shelf.

18. The casket portion of claim 17 wherein the locators are pins.

19. The casket portion of claim 18 wherein the pins are dowel pins.

* * * * *